US009361788B2

(12) United States Patent
Kamada

(10) Patent No.: US 9,361,788 B2
(45) Date of Patent: Jun. 7, 2016

(54) RECEIVER OF REMOTE CONTROL DEVICE

(71) Applicant: MURATA MACHINERY, LTD., Kyoto-shi, Kyoto (JP)

(72) Inventor: Kenichi Kamada, Kyoto (JP)

(73) Assignee: MURATA MACHINERY, LTD., Kyoto (JP)

( * ) Notice: Subject to any disclaimer, the term of this patent is extended or adjusted under 35 U.S.C. 154(b) by 199 days.

(21) Appl. No.: 14/337,300

(22) Filed: Jul. 22, 2014

(65) Prior Publication Data

US 2015/0029006 A1 Jan. 29, 2015

(30) Foreign Application Priority Data

Jul. 26, 2013 (JP) ..... 2013-155861

(51) Int. Cl.
*G08C 17/02* (2006.01)

(52) U.S. Cl.
CPC ..... *G08C 17/02* (2013.01)

(58) Field of Classification Search
CPC .... G08C 17/02; G08C 19/22; G01D 5/24466; H03J 1/0025; H04L 1/08
See application file for complete search history.

(56) References Cited

U.S. PATENT DOCUMENTS 4,045,771 A * 8/1977 Loreck ..... H04L 1/08 714/823
8,149,084 B2 * 4/2012 Hauck ..... H03J 1/0025 340/12.22
2003/0043053 A1 * 3/2003 Schuckel ..... G08C 17/02 340/13.25
2008/0293364 A1 * 11/2008 Stephens ..... G05B 19/4185 455/67.11
2009/0021391 A1 * 1/2009 Kamiya ..... B25J 9/16 340/12.15
2013/0240719 A1 * 9/2013 Sato ..... G01D 5/24466 250/231.14

FOREIGN PATENT DOCUMENTS

JP 08-247788 A 9/1996
JP 09-005114 A 1/1997

* cited by examiner

*Primary Examiner* — Nabil Syed
(74) *Attorney, Agent, or Firm* — Keating & Bennett, LLP

(57) ABSTRACT

A receiver of a remote control device includes a receiver configured to receive by wireless communication, a packet including a count value of edges of pulse signals, which are output from an encoder, per a predetermined period and to obtain the count value from the received packet, a register configured to retain the count value based on a write signal input from the receiver, and a pulse regenerating circuit including a counter in which the count value of the register is set based on the write signal input from the receiver, and configured to regenerate the pulse signals at an edge period that corresponds to the count value set in the counter in the predetermined period that corresponds to the write signal. In a case where a new write signal is input before an end of the predetermined period that corresponds to a write signal input most recently, the pulse regenerating circuit is configured to reset the counter, to set in the counter, a count value newly set in the register, and to regenerate the pulse signal at an edge period that corresponds to the new count value.

6 Claims, 3 Drawing Sheets

RECEIVER OF REMOTE CONTROL DEVICE

CROSS-REFERENCE TO RELATED APPLICATIONS

This application claims priority under 35 U.S.C. 119 to Japanese Patent Application No. 2013-155861, filed on Jul. 26, 2013, which application is hereby incorporated by reference in its entirety.

BACKGROUND OF THE INVENTION

1. Field of the Invention

The present invention relates to a remote control device configured to operate an industrial machine such as a machine tool, a textile machine, and a transportation device.

2. Description of the Related Art

An industrial machine such as the machine tool, a textile machine, and a transportation machine is configured so as to be operable by a person via a remote control device connected by a cable. The remote control device for operating the machine tool, for example, operates a stage or a loader by use of a rotary encoder. The rotary encoder outputs two signals of an A output and a B output, and the signals are input to a control board of the machine tool (the industrial machine) through the cable.

Since such a wired remote control device is connected to a main body of the industrial machine via the cable, a field of activities of an operator is limited by the cable, and furthermore, there is an inconvenient aspect in that care must be taken to handle the cable. A use of wireless communication is thus considered.

Upon employment of the wireless communication, it is considered that, for example, sampling the pulse signals of the A output and the B output of the rotary encoder is executed on a periodic basis and then the pulse signals are transmitted via a network such as a wireless LAN (wireless Local Area Network). However, since a packet is transmitted with short periods, a problem arises in which a traffic is increased.

Although not in a field of the remote control device, in a field of an AC servo motor, there is known an art in which outputs of the A output and the B output from the rotary encoder are counted by an edge counter, the count value indicating a rotational position is transmitted by wired serial communication, and then signals of the rotary encoder are regenerated based on the received data.

SUMMARY OF THE INVENTION

However, even if the above-described art of wired communication is applied to the wireless communication, by variation in a period of time required for processing the packet, a fluctuation occurs in a timing where a receiver regenerates the signals of the A output and the B output from the received packet. As a result, the signals of the rotary encoder cannot be reliably regenerated as same as the signals in the remote control device. In a case where such a fluctuation occurs, an operation to the rotary encoder cannot be smoothly replicated in the industrial machine (the machine tool), thus causing the stage or the loader to move in an unnatural manner.

Preferred embodiments of the present invention were developed focusing on such problems, and provide, in a remote control device in which wireless communication is used, a receiver of the remote control device in which an operation to the rotary encoder is smoothly replicated.

A receiver of a remote control device according to a preferred embodiment of the present invention includes a receiver configured to receive by wireless communication, a packet having a count value of edges of pulse signals, which are output from an encoder, per a predetermined period and to obtain the count value from the received packet, a register configured to retain the count value based on a write signal input from the receiver, and a pulse regenerating circuit including a counter in which the count value of the register is set based on the write signal input from the receiver, and configured to regenerate the pulse signals at an edge period that corresponds to the count value set in the counter in the predetermined period that corresponds to the write signal. The pulse regenerating circuit is configured to reset the counter in a case where a new write signal is input before an end of the predetermined period that corresponds to a write signal input most recently, to set in the counter, a count value newly set in the register, and to regenerate the pulse signals at an edge period that corresponds to the new count value.

With this configuration, in a case where processing of receiving the packet having the count value is performed early, regeneration of the present pulse signals is stopped and regeneration of pulse signals based on the new count value is started, thus allowing smooth replication of an operation to the encoder. Furthermore, a state is prevented where, although transmission from the remote control device has been completed, delay of every packet accumulates and regenerated signals continue to be output from the receiver.

To prevent an unnatural movement while preventing an increase in a circuit size, the pulse regenerating circuit in which a plurality of the edge periods is preferably set in advance in accordance with count values preferably regenerates the pulse signals at the edge period that corresponds to the count value.

The encoder preferably may be an rotary encoder.

The receiver preferably may be configured to function as an access point of a wireless LAN.

Since various preferred embodiments of the present invention have the above-described configurations, in a case where the processing of receiving the packet is performed early, the regeneration of the present pulse signals is stopped and the regeneration of the new pulse signals is started, thus allowing the smooth replication of the operation to the encoder.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Next, a remote control device of an industrial machine and a receiver thereof according to preferred embodiments of the present invention will be described with reference to the accompanying drawings.

Figure 1:
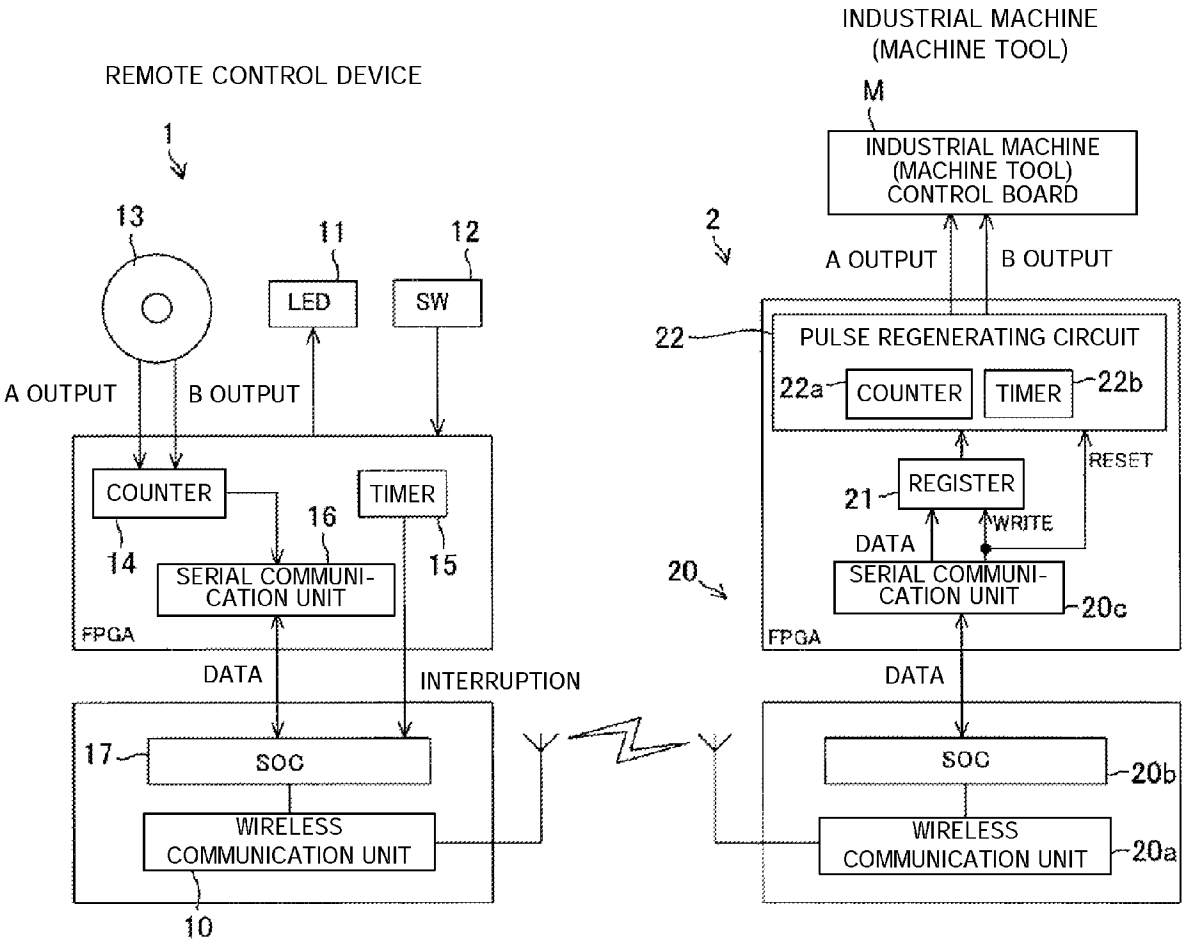
FIG. 1 is a diagram schematically illustrating a remote control device and a receiver thereof according to a preferred embodiment of the present invention.

As schematically illustrated in FIG. 1, a remote control device 1 of an industrial machine M and a receiver 2 thereof are configured to communicate with each other by use of a wireless communication technology defined by IEEE802.11, for example.

As illustrated in FIG. 1, the remote control device 1 of the industrial machine M includes a wireless communication unit 10 configured to be capable of wirelessly communicating with the receiver 2 of the industrial machine M, an LED (Light Emitting Diode) 11 configured to display various types of states, a switch 12 used for an operation, a rotary encoder 13 used for the operation, a counter 14, a timer 15, and a serial communication unit 16. The rotary encoder 13 is configured to output pulse signals having an A output and a B output while being rotated by the operation. The pulse signals of the A output and the B output have a phase difference of 90 degrees. The counter 14 is configured to count edges of the pulse signals (the A output, the B output) output from the rotary encoder 13. The edges of the pulse signals include a rising of a pulse or a falling of the pulse. The serial communication unit 16 is configured to be capable of transferring by serial communication a count value of the counter to a SOC (System On a Chip) 17 connected to the wireless communication unit 10. The timer 15 is configured to perform interruption processing on the SOC 17 at every predetermined period. The interruption processing is processing in which the count value of the counter 14 is transmitted to the receiver 2 via the serial communication unit 16 and the wireless communication unit 10. Consequently, a packet including the count value of the edges of the pulse signals (the A output, the B output), which are output from the encoder 13, per a predetermined period is transmitted from the remote control device 1.

In the present preferred embodiment, the counter 14, the timer 15, and the serial communication unit 16 preferably are implemented by a FPGA (Field Programmable Gate Array), but may be implemented by a gate array, for example. In the present preferred embodiment, since an incremental rotary encoder is preferably used, the count value indicates a relative change in a rotational position and is only a (plus/minus) sign representing a rotational direction, and a number of counts.

The receiver 2 of the remote control device 1 includes, as illustrated in FIG. 1, a receiver 20 configured to receive the packet by wireless communication and to obtain the count value from the received packet, a register 21, and a pulse regenerating circuit 22.

The receiver 20 includes a wireless communication unit 20*a* configured to be capable of wirelessly communicating with the remote control device 1, a SOC (System On a Chip) 20*b* connected to the wireless communication unit 20*a*, and a serial communication unit 20*c* configured to be capable of performing serial communication with the SOC 20*b*. Upon receiving the packet including the count value, the wireless communication unit 20*a* obtains the count value from the received packet and transmits the count value to the serial communication unit 20*c* via the SOC 20*b*. Upon receiving the count value, the serial communication unit 20*c* inputs a write signal (WRITE in the drawing) to the register 21 to cause the register 21 to retain the count value, and inputs the write signal (RESET in the drawing) to the pulse regenerating circuit 22. The wireless communication unit 20*a* serving as the receiver 20 is configured to define and function as an access point of a wireless LAN.

When a pulse of the write signal is input, the register 21 sets the new count value to retain the count value.

The pulse regenerating circuit 22 includes a counter 22*a* in which when the write signal (also referred to as a reset signal) is input, the count value of the register 21 is set, and a timer 22*b* configured to measure a predetermined period T. The period T measured by the timer 22*b* is set so as to correspond to a period of a timer 15 of the remote control device 1.

In the pulse regenerating circuit 22, a plurality of edge periods is set in advance in accordance with count values. For example, in a case where the period T is about 12.8 msec and the count value is −2~1, the edge period is preferably set to about 6.4 msec. In a case where the count value is 3~2, −4~−3, the edge period is preferably set to about 3.2 msec, for example. In a case where the count value is 31~16, −32~−17, the edge period is preferably set to 400 μsec, for example. In a case where the count value is 64~32, −6~−33, the edge period is set to 200 μsec, for example. In these cases, a circuit is designed such that the edge period is changed in accordance with significant bits of the count value. In such a manner, since the plurality of edge periods is set in advance in accordance with count values, without using a dividing circuit of dividing one predetermined period by the count value, edges are distributed in a uniform or substantially uniform manner over the predetermined period T, thus allowing prevention of an unnatural movement of an industrial equipment and control of a circuit size of a receiver.

Figure 2A:
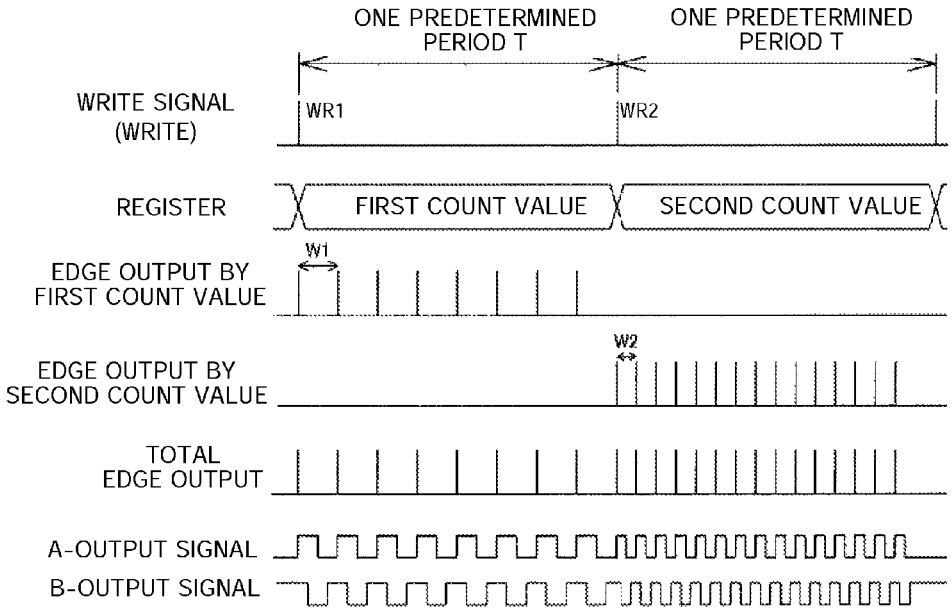
FIG. 2A is an explanatory diagram relating to pulse signals regenerated by the receiver.

As illustrated in FIGS. 1 and 2A, when a pulse WR1 of the write signal is input, in the predetermined period T that corresponds to the pulse WR1 of the write signal, the pulse regenerating circuit 22 outputs the pulse signals (the A output, the B output) at an edge period W1 that corresponds to a first count value set in the register 21 and the counter 22*a*. Furthermore, when a next pulse WR2 of the write signal is input, in the predetermined period T that corresponds to the pulse WR2 of the write signal, the pulse regenerating circuit 22 outputs the pulse signals (the A output, the B output) at an edge period W2 that corresponds to a second count value.

Figure 2B:
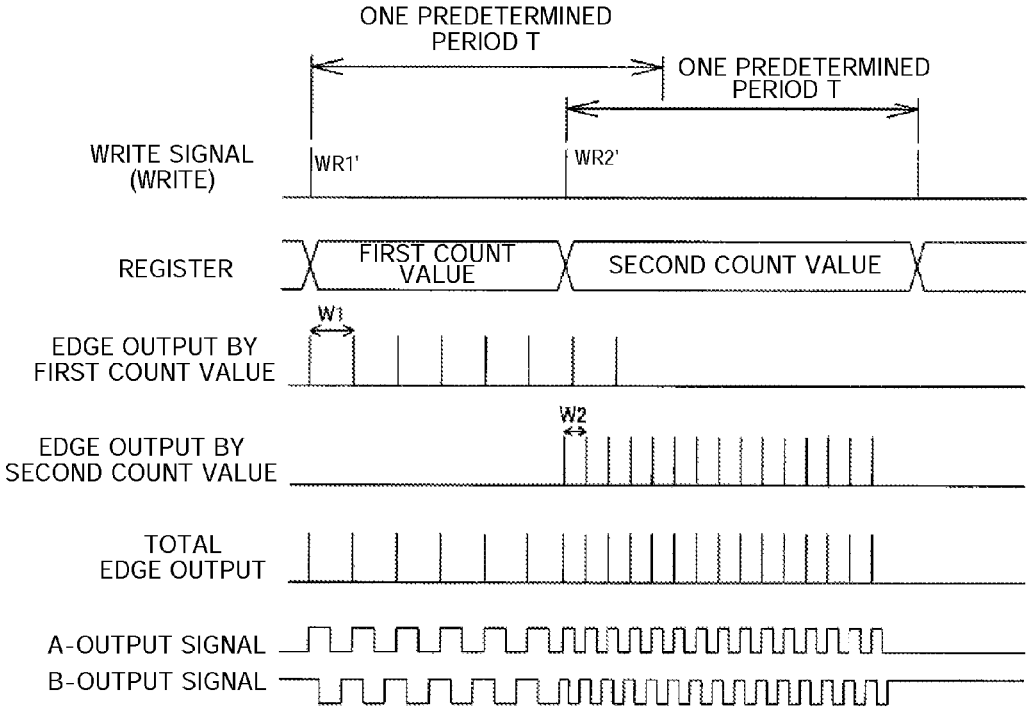
FIG. 2B is an explanatory diagram relating to pulse signals regenerated by the receiver.

As illustrated in FIGS. 1 and 2B, when a new pulse WR2' of the write signal is input before an end of the predetermined period T that corresponds to a pulse WR1' of the write signal input most recently, the pulse regenerating circuit 22 is configured to reset the counter 22*a*, to set in the counter 22*a*, a count value newly set in the register 21, and then to regenerate the pulse signals at an edge period that corresponds to the new count value (a second count value in FIG. 2B). In other words, when the pulse WR2' of the write signal is input while the pulse signals are being regenerated at the edge period W1 based on a first count value, the pulse regenerating circuit 22 stops outputting the pulse signals based on the first count value and regenerates the pulse signals at the edge period W2 based on the new second count value. In addition, when the pulse WR2' of the write signal is input, the timer 22*b* is also reset. The timer 22*b* starts measuring the predetermined period T from the beginning.

In the present preferred embodiment, the serial communication unit 20*c*, the register 21, and the pulse regenerating circuit 22 are preferably implemented by a FPGA (Field Programmable Gate Array), but may be implemented by a gate array, an ASIC (Application Specific Integrated Circuit), a DSP(Digital Signal Processor), and the like, for example.

As described above, the receiver 2 of the remote control device 1 of the present preferred embodiment includes the receiver 20 configured to receive by the wireless communication, the packet having the count value of the edges per the predetermined period T of the pulse signals output from the encoder 13 and to obtain the count value from the received packet, the register 21 configured to retain the count value based on the write signal input from the receiver 20, and the pulse regenerating circuit 22 having the counter 22*a* in which the count value of the register 21 is set based on the write signal input from the receiver 20, and configured to regenerate the pulse signals at the edge period that corresponds to the count value set in the counter 22*a* in the predetermined period T that corresponds to the write signal. When the new pulse WR2' of the write signal is input before the end of the predetermined period T that corresponds to the pulse WR1' of the write signal input most recently, the pulse regenerating circuit 22 resets the counter 22*a,* sets in the counter 22*a,* the count value newly set in the register 21, and then regenerates the pulse signals at the edge period that corresponds to the new count value.

With the configuration, when processing of receiving the packet including the count value is performed early, regeneration of the present pulse signals is stopped and regeneration of pulse signals based on the new count value is started, thus allowing smooth replication of an operation to the encoder. Furthermore, a state is prevented where although the transmission from the remote control device has been completed, delay of every packet accumulates and regenerated signals continue to be output from the receiver.

In the present preferred embodiment, the pulse regenerating circuit 22 in which the plurality of edge periods is set in advance in accordance with count values regenerates the pulse signals at the edge period that corresponds to the count value.

In such a manner, since the plurality of edge periods is set in advance in accordance with count values, without using the dividing circuit to divide a predetermined period by the count value, the edges are distributed in a uniform or substantially uniform manner over the predetermined period, thus allowing control of increase in circuit size and prevention of the unnatural movement.

In the present preferred embodiment, an encoder is a rotary encoder and therefore is preferable as an example of application of the present invention.

In the present preferred embodiment, the receiver 20 is configured to function as the access point of the wireless LAN and therefore is preferable as an example of application of the present invention.

Illustrative configurations of each component are not limited to the above-described preferred embodiments, and various modifications may be made without departing from the scope of the present invention.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A receiver of a remote control device comprising:

a receiver configured to receive by wireless communication, a packet including a count value of edges of pulse signals per a predetermined period, the pulse signals being output from an encoder, and to obtain the count value from the received packet;

a register configured to retain the count value based on a write signal input from the receiver; and a pulse regenerating circuit including a counter in which the count value of the register is set based on the write signal input from the receiver, and configured to regenerate the pulse signals at an edge period that corresponds to the count value set in the counter in the predetermined period that corresponds to the write signal; wherein the pulse regenerating circuit is configured and programmed to:

regenerate the pulse signals at the edge period that corresponds to the count value set in the counter in the predetermined period that corresponds to the write signal;

reset the counter in a case in which a new write signal is input before an end of the predetermined period that corresponds to a write signal input most recently; and set in the counter, a new count value that is newly set in the register, and regenerate the pulse signals at an edge period that corresponds to the new count value.

2. The receiver of the remote control device according to claim 1, wherein the pulse regenerating circuit in which a plurality of the edge periods is set in advance in accordance with count values is configured to regenerate the pulse signals at the edge period that corresponds to the count value.

3. The receiver of the remote control device according to claim 1, wherein the encoder is a rotary encoder.

4. The receiver of the remote control device according to claim 2, wherein the encoder is a rotary encoder.

5. The receiver of the remote control device according to claim 1, wherein the receiver is configured to function as an access point of a wireless LAN.

6. The receiver of the remote control device according to claim 1, further comprising a timer configured to measure the predetermined period and to be reset by the write signal.

* * * * *